US005490467A

United States Patent [19]

Diffrient

[11] Patent Number: 5,490,467

[45] Date of Patent: Feb. 13, 1996

[54] FOLDING TABLE MECHANISM

[75] Inventor: Niels Diffrient, Ridgefield, Conn.

[73] Assignee: Howe Furniture Corporation, Trumbull, Conn.

[21] Appl. No.: 363,366

[22] Filed: Dec. 23, 1994

[51] Int. Cl.[6] ..... A47B 3/00

[52] U.S. Cl. ..... 108/133; 108/129; 248/188.6

[58] Field of Search ..... 108/133, 132, 108/131, 129, 156; 248/188.6, 439, 166

[56] References Cited

U.S. PATENT DOCUMENTS

| | | | |
|---|---|---|---|
| 2,144,049 | 1/1939 | Forcier | 108/132 X |
| 2,690,942 | 10/1954 | Marcus | 108/132 X |
| 3,554,141 | 1/1971 | Burr | 108/132 |
| 4,064,814 | 12/1977 | Baum | 108/129 |
| 4,444,124 | 4/1984 | Burr | 108/132 X |
| 4,573,415 | 3/1986 | Ramey | 108/129 |
| 4,838,180 | 6/1989 | Gutgsell | 108/132 |
| 5,109,778 | 5/1992 | Berkowitz et al. | 108/133 X |
| 5,279,223 | 1/1994 | Cox | 108/132 X |
| 5,323,713 | 6/1994 | Luyk et al. | 108/131 |

FOREIGN PATENT DOCUMENTS

| | | | |
|---|---|---|---|
| 1218548 | 5/1960 | France | 108/133 |
| 557034 | 8/1932 | Germany | 108/133 |
| 6237823 | 8/1994 | Japan | 108/129 |

*Primary Examiner*—Jose V. Chen
*Attorney, Agent, or Firm*—Parmelee, Bollinger & Bramblett

[57] ABSTRACT

A mechanism for folding the T-leg of a table is contained within a tubular housing carried by the end of the pedestal portion of the leg. Spring-loaded cams at each end of the housing slide in slotted frames mounted to the underside of the table. A locking shoulder at one end of each slot retains its cam in a locking position and a lever associated with each cam unlocks it and allows the leg to fold.

12 Claims, 3 Drawing Sheets

FOLDING TABLE MECHANISM

TECHNICAL FIELD

This invention relates to folding tables. More particularly, it relates to a mechanism for folding the T-leg of such a table.

BACKGROUND ART

Folding tables and, in particular, folding tables having T-legs, are well known. However, the folding tables known to the prior art have certain deficiencies which it would be desirable to have corrected. One such deficiency is that the mechanisms are substantially exposed. This creates several problems. One problem is that the exposed mechanism makes it possible for the hands or fingers of a user to be pinched or otherwise injured. Another problem is that the mechanisms, being exposed, are subject to possible damage, particularly when folding tables are stacked one upon another. Another problem is aesthetic in that the mechanisms are unattractive. Another problem is that it is often necessary to actuate more than one locking device, requiring the use of two hands to fold a table. If only one release mechanism is employed, it often can be reached from only one side of the table. On the other hand, if a dual release mechanism is employed, it increases tolerance problems.

Accordingly, it is a primary object of the present invention to provide a mechanism for the leg of a folding table which is particularly compact. Other objects are to provide such a mechanism wherein the operating mechanism is housed and hidden from view and wherein each leg may be folded by a release mechanism easily reached from either side of the table but without additional tolerance problems. The manner in which these objects are achieved will be more apparent from the following description and appended claims.

DISCLOSURE OF INVENTION

The invention comprises a leg which is connected to a tubular housing. The housing extends between two frames mounted on the under surface of the table. Carried within the housing is a cross rod and a pair of torsion springs. The springs are connected to locking cams carried in slots in the respective mounting frames, each of said slots including a locking shoulder. When the table is in the erect and locked position, the cams engage the locking shoulders. A lever is provided which simultaneously releases both cams to slide along their respective slots. However, the cams are under the direct control of the springs and only loosely related to their respective levers, thereby reducing tolerance problems. Other means are provided for pivoting the leg into its storage position parallel to the bottom surface of the table top.

BEST MODE FOR CARRYING OUT THE INVENTION

Figure 1:
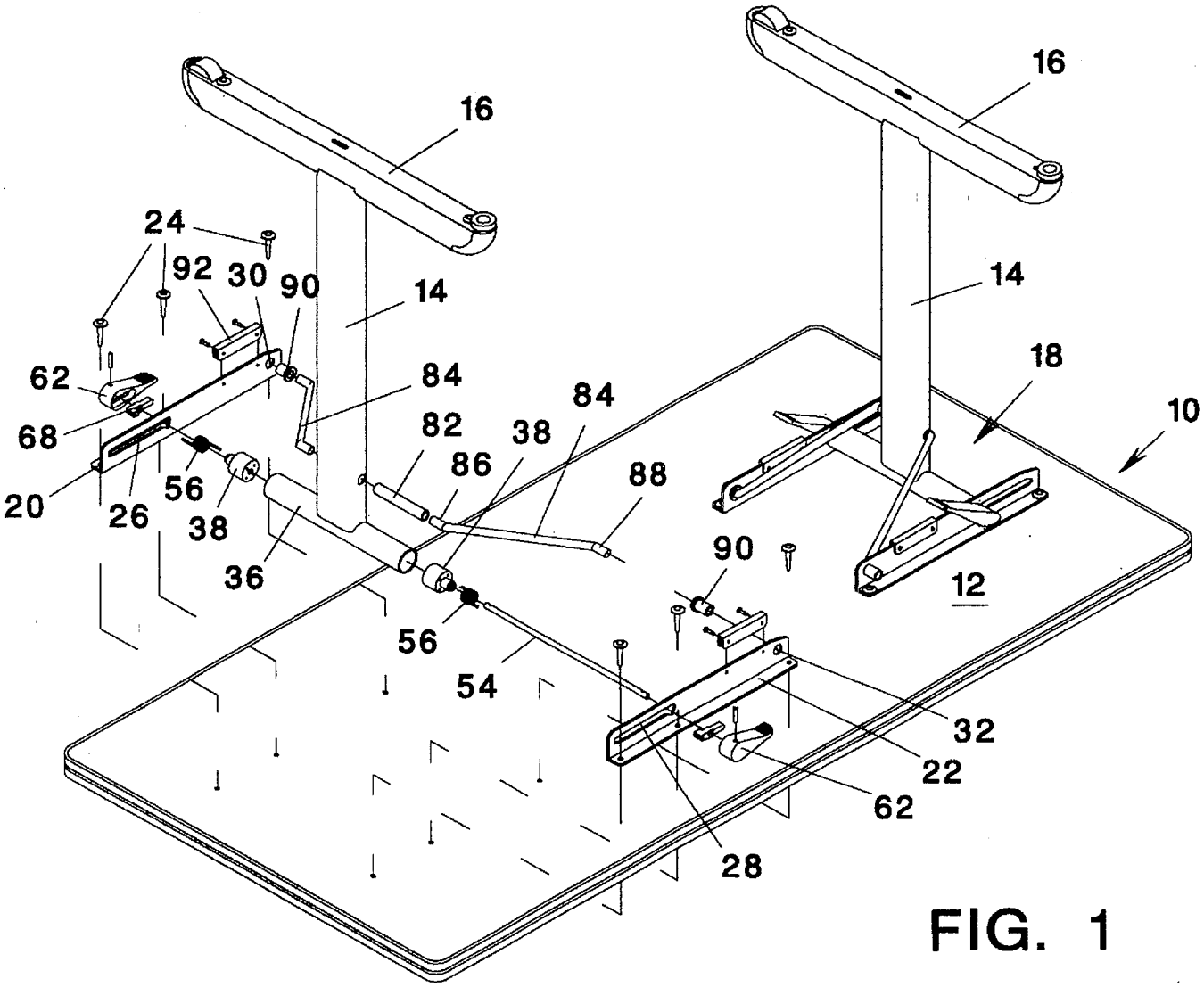
FIG. 1 is an isometric, partially exploded, view of an inverted table incorporating the present invention.

Referring first to FIG. 1, there is illustrated a table in accordance with this invention comprising a top 10 having an under surface 12. The top is normally supported by a pair of T-legs, each including a pedestal 14 and a horizontal base 16. The T-legs are foldable against the under surface 12 of the table top 10 by means of a folding mechanism 18. Except for orientation, the folding mechanisms of the two legs are identical. The mechanism on the left, as viewed in FIG. 1, is shown in exploded form to better illustrate its construction. Since the two mechanisms are identical, similar reference numerals will be employed in the following description.

Figure 2:
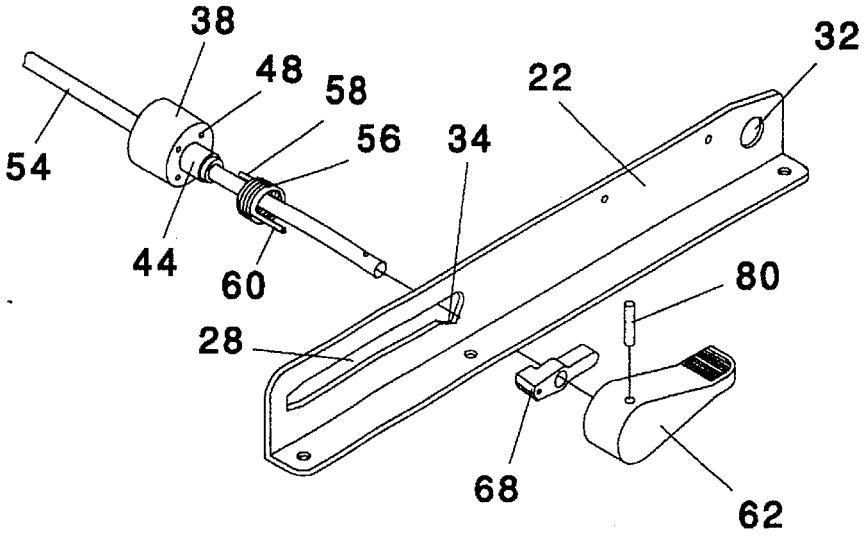
FIG. 2 is an enlarged exploded isometric view illustrating a portion of the invention.

Mounted to the under surface 12 of the table top 10 are a pair of mounting frames 20, 22. The frames are made from angle irons and are mounted to the tabletop by means of screws 24. The mounting frames 20, 22 are mirror images of one another and the flange portions which extend vertically from the under surface 12 of the table top define at one end a pair of aligned slots 26, 28. The opposite end of each vertical flange carries a pivot hole 30, 32. FIG. 2 illustrates the mounting frame 22 in more detail. As seen therein, slot 28 terminates at one end in a locking shoulder 34.

The pedestal 14 of each T-leg is essentially oval in cross-section and carries at its upper end (adjacent the tabletop) a cylindrical tubular housing 36. The length of the housing 36 is such as to fit, and be rotatable between, the mounting frames 20, 22.

Figure 6:
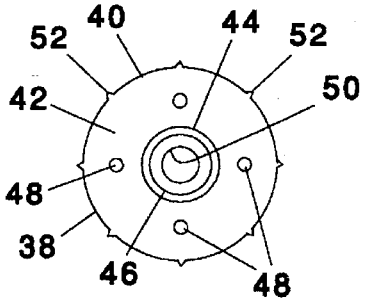
FIG. 6 is an enlarged detail of an axle plug employed in this invention.

Mounted within each end of the housing 36 is an axle plug 38. Each axle plug includes a substantially cylindrical body 40 having an end face 42 (FIG. 6) from which extends a shaft 44 terminating in a necked-down stub 46. Four spaced holes 48 extend into the end face 42 and a passage 50 extends axially through the entire plug. In one embodiment, the axle plug 38 is formed of sintered steel and carries on its outer surface a plurality of spaced sharp ribs 52. When the axle plug 38 is driven into the end of the housing 36, these ribs securely position the axle plug in place. Extending through the passages 50 in the two axle plugs 38 is a cross rod 54. The cross rod 54 is rotatable within the passages 50 of the axle plugs and at each end it extends through the corresponding slot 26, 28 in the mounting frames 20, 22.

Encircling the shaft 44 of each of the axle plugs 38 is the body of a cylindrical torsion spring 56. As is illustrated most clearly in FIG. 2, each of the torsion springs 56 includes a first spring leg 58 which extends longitudinally into one of the holes 48 in the face of the axle plug. A second spring leg 60 extends in the opposite direction through the slot 28.

Figure 3:
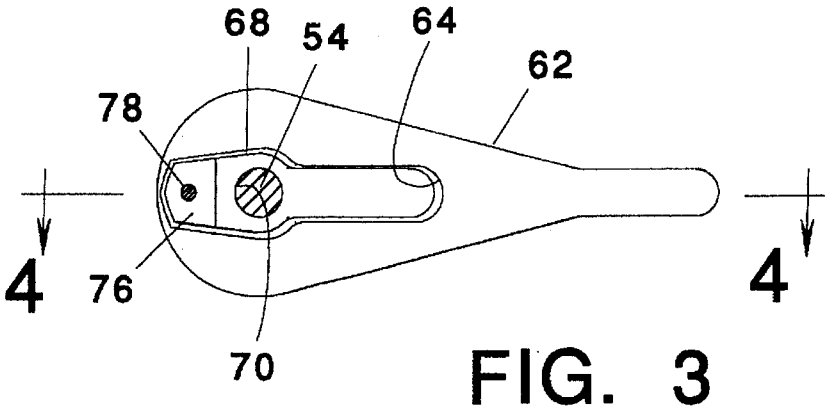
FIG. 3 is a bottom view of a lever and cam usable in this invention.
Figure 4:
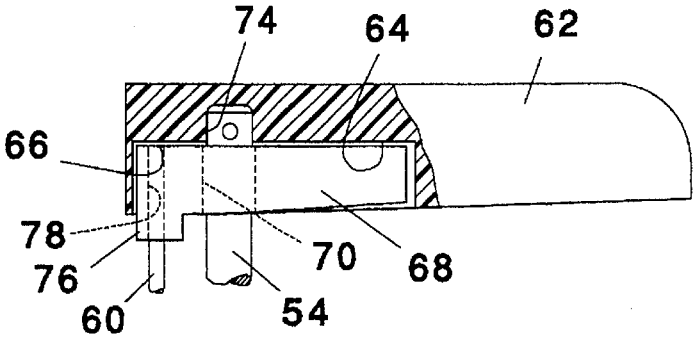
FIG. 4 is a cross-section taken substantially along the line 4—4 of FIG. 3.
Figure 5:
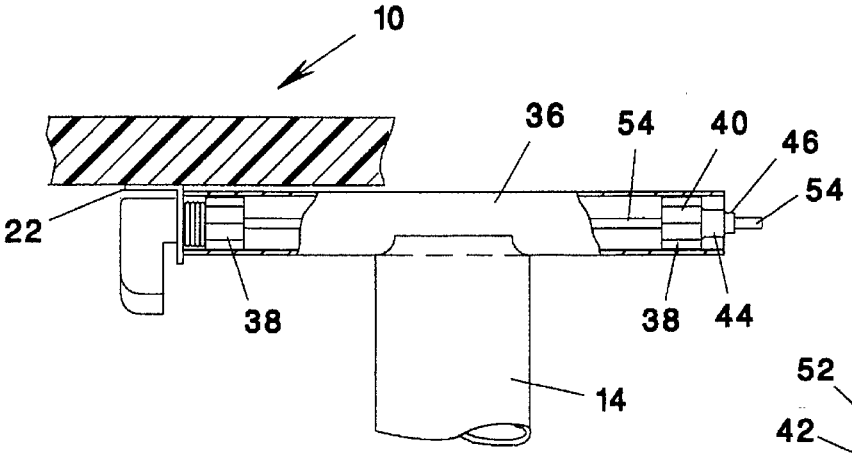
FIG. 5 is a partial elevational view illustrating the tubular housing of the invention.

A cam and lever assembly is mounted to the end of the cross rod 54, as is shown most clearly in FIGS. 2–4. A release lever 62, which may be made of a suitable plastic, defines a recess 64 for retaining a locking cam 68. As will be clear from FIGS. 3 and 4, the recess is larger than, and only loosely receives, the locking cam 68. The locking cam may be made, for example, of sintered steel. A hole 70 through the locking cam 68 is aligned with a socket 74 in the release lever 62. The end of the cross rod 54 extends through the hole 70 and into the socket 74. However, the cross rod 54 and the locking cam 68 are relatively rotatable. The left end of the locking cam 68, as viewed in FIGS. 3 and 4, carries a projecting latch 76. A hole 78 in the latch 76 receives the second spring leg 60 of the torsion spring 56. The release lever 62 and the end of cross rod 54 are assembled together by means of a pin 80 which passes through them.

When the mechanism thus far described is fully assembled and the leg is in the erected position, the torsion spring 56 maintains the lever 62 and locking cam 68 in a counterclockwise orientation as viewed in FIG. 2. The projecting latch 76 on the locking cam engages the locking shoulder 34 and the locking lever 62 is at an angle of approximately 45° from the underneath side 12 of the table top 10.

Extending through the pedestal 14 is a tubular cross axle 82. Each end of the cross axle 82 is secured to one end of a diagonal brace 84. The diagonal braces 84 are somewhat Z-shaped, including two offset ends. One end 86 is secured to the cross axle 82. The other end 88 passes through a flanged bushing 90 mounted in the pivot hole 30, 32 of the respective mounting frame 20, 22.

Figure 7:
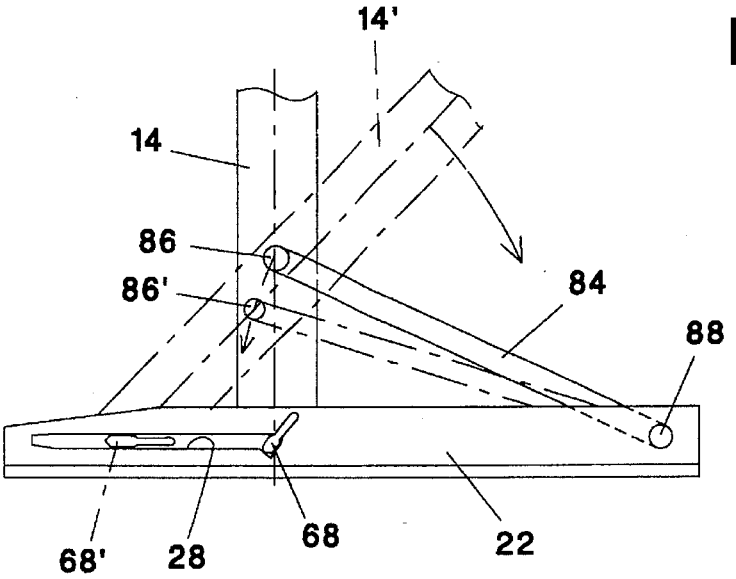
FIG. 7 is a partially schematic illustration of the folding action of the table leg of this invention.

The operation of the mechanism of this invention may be best understood by reference to FIG. 7. When the pedestal 14 is in its locked position for supporting the table, the locking cam 68 securely engages the locking shoulder 34 at the end of the slot 28. It is maintained in this position by the torsion spring 56 enclosed within the housing 36. As explained above, the release levers 62 (not shown) enclose the locking cams 68 within enlarged recesses 64 so that each is free to move a few degrees of angle differently from one side to the other. When the release lever 62 on either side of the mechanism is depressed, the clearance between the recesses and the locking cams is used up. As a result, the cross rod 54 and both of the locking cams 68 are rotated so that both latches 76 rotate away from their respective locking shoulders. In this position, the locking cam 68' is free to slide along the slot 28 as shown in FIG. 7. As it slides, the pedestal 14 rotates downwardly around the end 86 of the diagonal brace 84 which, in turn, pivots about its other end 88. In this fashion, the T-leg of the table is depressed onto the under surface 12 of the table top 10 making a compact and easily stored or stacked unit. One additional feature of this invention is the addition on each of the mounting frames 20, 22 of a resilient stacking bumper 92 to protect the table surfaces when stacked.

The torsion springs 56 are wound in such a manner as to assist in achieving a positive locking engagement. Referring to FIG. 7, the phantom line illustrations show the assembly in a position partway between folded and erected. In going from the folded to the erected position, the locking cam 68' moves from left to right (referring to the illustration). However, it is restrained by the slot 28 to a horizontal configuration. During this time, the pedestal 14' is rotating counterclockwise about the diagonal brace end 86. As a result, the locking cam 68' is rotating clockwise relative to the cross rod 54 and forcing the spring leg 60 to rotate clockwise relative to the spring leg 58. As a result, energy is stored in the torsion spring 56 which, upon reaching the locking shoulder 34, is released and forces the locking cam 68 into its locking position.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

I claim:

1. In a table having a top with an under surface, at least one leg, and a mechanism for folding said leg between an upright position supporting said table top and a storage position substantially parallel with, and alongside, said under surface, the improvement wherein said folding mechanism comprises:

first and second spaced, substantially parallel, mounting frames carried by the under surface of said table top on opposite sides of said leg, said first frame defining a first slot therein and said second frame defining a second slot therein, said slots having aligned locking shoulders;

a tubular housing carried by said leg having first and second ends and extending substantially between said first and second frames;

a cross rod carried by said leg within said housing and having a first end terminating at said first mounting frame and a second end terminating at said second mounting frame;

first and second locking cams carried by the respective first and second ends of said cross rod and positioned in the respective first and second slots for rotation therein between a locking position engaging a respective locking shoulder and a release position wherein each of said cams is slidable in its respective slot;

means mounted within said tubular housing for resiliently urging each of said cams into its locking position;

release means for rotating said cross rod and lifting both of said cams out of their locking positions; and means for pivoting said leg into its storage position while sliding said cams within their respective slots.

2. The improvement of claim 1 wherein said resilient means comprises a spring.

3. The improvement of claim 2 wherein said spring is a torsion spring.

4. The improvement of claim 1 wherein at least one of said first and second locking cams is rotatable relative to said cross rod.

5. The improvement of claim 1 wherein said release means is a manually operable lever.

6. The improvement of claim 5 wherein a different lever encloses each of said first and second locking cams.

7. The improvement of claim 6 wherein each of said levers defines a recess loosely enclosing its respective locking cam.

8. The improvement of claim 1 wherein first and second axle plugs are housed, respectively, within the first and second ends of said tubular housing and support said cross rod therebetween.

9. The improvement of claim 8 wherein said resiliently urging means are first and second substantially cylindrical torsion springs, each having a first leg secured by a respective one of said axle plugs and a second leg engaging a respective one of said locking cams.

10. The improvement of claim 9 wherein said pivoting means comprises first and second braces, each having a first end pivotally retained in said leg and a second end pivotally retained in a respective one of said first and second mounting frames.

11. The improvement of claim 10 wherein said release means is a manually operable lever.

12. The improvement of claim 11 wherein a different lever encloses each of said first and second locking cams.

* * * * *